US005785196A

United States Patent [19]

Montgomery

[11] Patent Number: 5,785,196

[45] Date of Patent: Jul. 28, 1998

[54] CLOSURE FOR A PRESSURIZED CONTAINER

[75] Inventor: Gary V. Montgomery, Evansville, Ind.

[73] Assignee: Rexam Closures Inc., Evansville, Ind.

[21] Appl. No.: 739,302

[22] Filed: Oct. 29, 1996

Related U.S. Application Data

[63] Continuation of Ser. No. 455,650, May 31, 1995, abandoned.

[51] Int. Cl.[6] ..... B65D 41/00

[52] U.S. Cl. ..... 215/354; 215/307; 215/270; 215/344; 215/902; 215/DIG. 1; 220/366.1; 220/367.1; 220/240

[58] Field of Search ..... 215/260, 270, 215/307, 341, 343, 344, 354, 356, 357, 902, DIG. 1; 220/231, 322, 913, 240, 366.1, 203.09, 367.1

[56] References Cited

U.S. PATENT DOCUMENTS

| | | | |
|---|---|---|---|
| 3,043,463 | 7/1962 | Beall, Jr. | 215/260 |
| 3,144,154 | 8/1964 | Puse et al. | 215/260 |
| 3,181,720 | 5/1965 | Cassie et al. | 220/366.1 X |
| 3,381,872 | 5/1968 | Holder et al. | 220/203.09 |
| 3,494,496 | 2/1970 | Livingstone | 215/344 X |
| 3,613,938 | 10/1971 | Westcott | 220/366.1 X |
| 3,809,280 | 5/1974 | Park et al. | 220/366.1 X |
| 4,143,785 | 3/1979 | Ferrell . | |
| 4,231,489 | 11/1980 | Malone | 220/366.1 X |
| 4,276,989 | 7/1981 | Hicks . | |
| 4,392,055 | 7/1983 | Whitney | 215/307 |
| 4,560,077 | 12/1985 | Dutt | 215/307 |
| 4,574,966 | 3/1986 | Sandhaus . | |
| 4,640,428 | 2/1987 | Chang . | |
| 4,858,776 | 8/1989 | Mehra . | |
| 5,071,017 | 12/1991 | Stull | 215/260 |
| 5,161,707 | 11/1992 | Dutt et al. . | |
| 5,251,770 | 10/1993 | Bartley et al. | 220/366.1 X |
| 5,275,287 | 1/1994 | Thompson | 215/344 |
| 5,364,675 | 11/1994 | Guarriello et al. | 215/902 X |
| 5,450,973 | 9/1995 | Ellis et al. | 215/344 X |
| 5,630,522 | 5/1997 | Montgomery | 215/344 |

FOREIGN PATENT DOCUMENTS

| | | |
|---|---|---|
| 464384 | 1/1992 | European Pat. Off. . |
| 2340865 | 2/1976 | France . |
| WO80001061 | 5/1980 | WIPO . |

*Primary Examiner*—Allan N. Shoap
*Assistant Examiner*—Robin A. Hylton
*Attorney, Agent, or Firm*—Gifford, Krass, Groh, Sprinkle, Patmore, et al.

[57] ABSTRACT

The closure cap of a closure and container package for a pressurized liquid is designed with a sealing flange which depends from the cap top at an angle to a sealing location on the container wall so that an increase in container pressure will increase the sealing force of the flange against the container wall. A pressure relief passage is provided downstream of the sealing location.

6 Claims, 2 Drawing Sheets

CLOSURE FOR A PRESSURIZED CONTAINER

This is a continuation of application Ser. No. 08/455,650 filed on May 31, 1995 abandoned.

BACKGROUND OF THE INVENTION

Field of the Invention

This invention relates to a closure and container package for pressurized liquids. More particularly, this invention relates to improvements in sealing a pressurized closure - container package.

SUMMARY OF THE INVENTION

The present invention is directed to an enhanced seal between a closure and a container for a pressurized liquid such as a carbonated soft drink bottle. In the improved closure and container package of this invention, the sealing force is increased with an increase in container pressure. This is obtained with a closure having a top wall and an annular skirt depending from the periphery of the top wall by an annular flange which extends downwardly at an angle from the top wall to a sealing location on a wall of the container so that an increase in container pressure will increase the sealing force exerted by the flange. The seal is further enhanced by pressure equalizing means downstream from the sealing location. Downstream, as used in this application, is the direction outwardly from the pressurized container through the seal or seals to the atmosphere past the closure and container threads; thus, downstream from a seal is from the seal toward the atmosphere not toward the pressurized container.

The annular skirt has means for securing the cap to the container such as a thread or a snap bead, and an annular flange which is concentric and inside the cap skirt. In one embodiment, the annular flange is in the form of a folding bead which converges inwardly to seal against a neck lip wall of the container. In this embodiment a stop is used to prevent crushing of the folding bead. This stop can take the form of an annular shoulder extending inwardly from the cap top wall and the cap skirt.

In another embodiment, the annular flange diverges outwardly to seal against an inside container wall.

The pressure equalizing means in one embodiment provides a means for maintaining atmospheric pressure downstream from the sealing location to reduce the possibilities of breaking the seal. This is obtained by radial passages in the form of radially directed grooves or slots in the cap top or the lip of the container neck. For example, the inside of the cap top or the container lip can be knurled to provide a circumferential array of ridges and grooves or passages. This eliminates any pressure pocket, allowing the cap to breath.

In another mode, the pressure equalizing means provides a means for relieving pressure in the container to atmospheric pressure as the cap is being loosened but before the cap is removed from the container. This can be in the form of a passage or several passages on the inside wall of the container. In a conventional carbonated drink bottle these passages can be formed as circumferentially spaced axial grooves or slots in the container neck wall, or, alternatively, these passages can be formed by spaces between ribs that extend inwardly from the container wall. These grooves or ribs start above the sealing location and extend to the container neck lip so that pressure will be relieved when the cap has been unthreaded a sufficient amount to move the contact end of the annular flange axially into contact with the ribs or grooves, opening the container to these passages. These pressure relieving passages being above the sealing location are also considered to be downstream of the sealing location.

The passage can also take the form of a circumferential passage above the sealing location. This is particularly useful with a wide mouth container such as a drinking glass which has a snap engaging closure cap.

In many instances, the pressure equalizing means will include passages for maintaining atmospheric pressure downstream from the sealing location and additional passages downstream of the sealing location for relieving container pressure to atmospheric during the removal of the closure cap from the container.

BRIEF DESCRIPTION OF THE DRAWING

The advantages of the present invention will be more apparent from the following detailed description when considered in connection with the accompanying drawing wherein.

DESCRIPTION OF THE PREFERRED EMBODIMENTS

Figure 1:
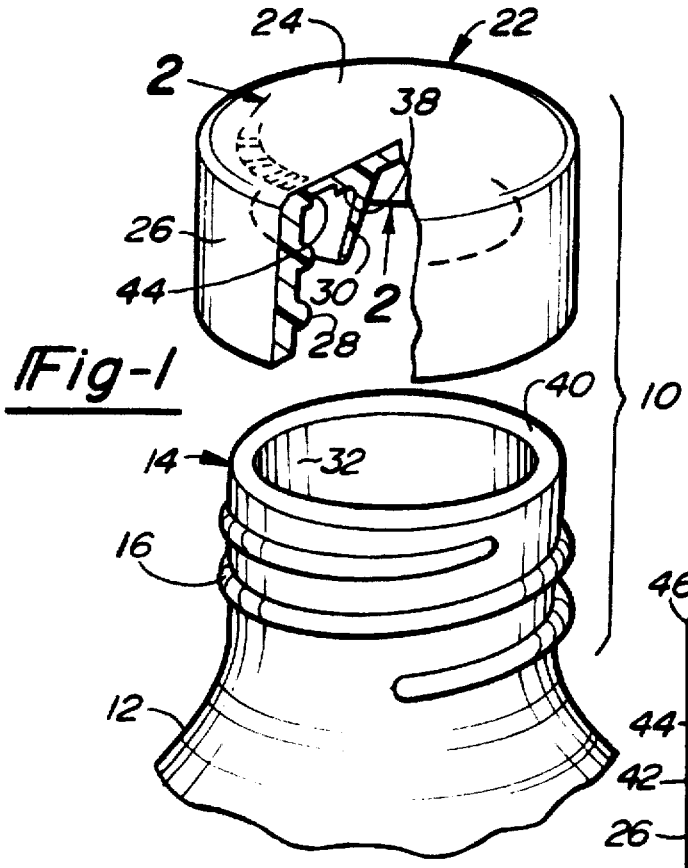
FIG. 1 is an exploded perspective view showing the closure of this invention as it is applied to a standard threaded container neck.
Figure 2:
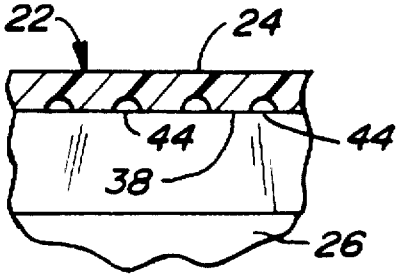
FIG. 2 is an enlarged partial sectional view taken along line 2—2 of FIG. 1.

The closure and container package 10 of the present invention includes a container 12 of primarily a standard design such as a bottle having a neck 14 with an external thread 16, as shown in FIGS. 1, 3, 4, 6 and 8, suitable for containing carbonated beverages. The container also can be of the wide mouth variety, such as the container 60 of the drinking glass type shown in FIGS. 10 and 11 having a snap bead 62 for retention of a closure and also suitable for containing pressurized liquids such as carbonated beverages.

Figure 3:
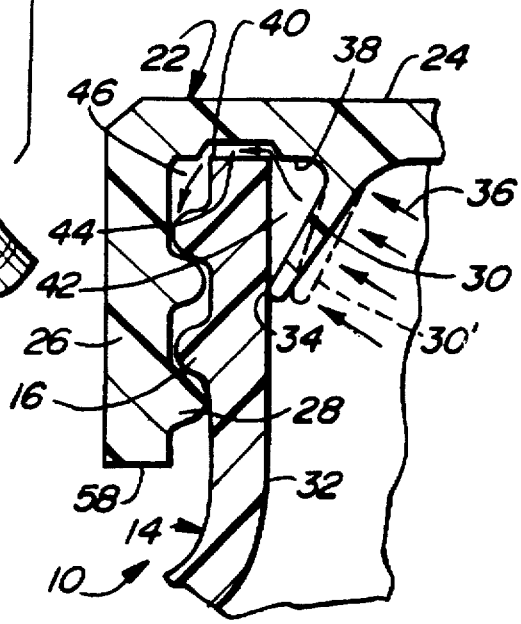
FIG. 3 is a sectional elevational view of the assembled closure cap and container package of FIG. 1.
Figure 4:
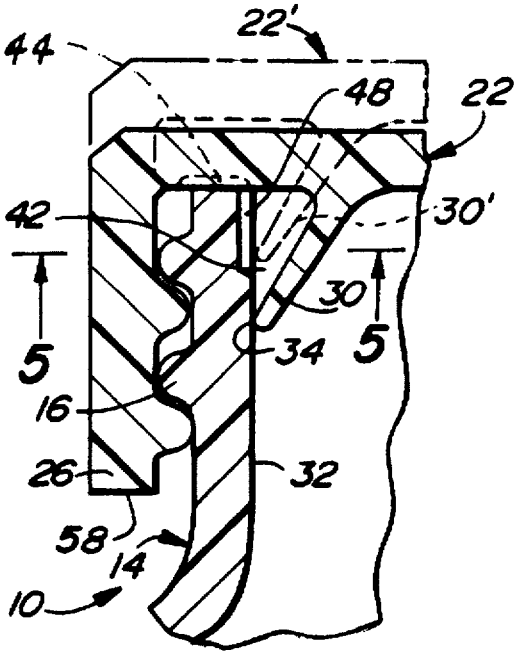
FIG. 4 is a sectional elevational view similar to FIG. 3 showing another embodiment of the invention.

The closure and container package 10 also includes a closure 22, which, as shown in FIGS. 1, 3 and 4, is a cap having a planar top 24 and an annular skirt 26 depending from the periphery of the top with an internal thread 28 for engaging the external thread 16 on the container neck. The cap may also carry a tamper indicating band, not shown, depending from the bottom of the cap skirt which cooperates with a flange, not shown, on the container neck to retain the band on the container neck during initial opening of the package.

An annular flange 30 extends downwardly from the top wall 24, diverging outwardly to contact the inner wall 32 of the container neck 14 at a sealing location 34 so that an increase in container pressure increases the force which the flange exerts against the inner wall 32 of the container neck 14. This is illustrated in FIG. 3 where the arrows 36 show how the container pressure pushes the flange from a relaxed position shown exaggerated at 30' in phantom to its sealed position shown in full line.

When the cap 22 is tightened on the container neck 14, the inside wall 38 of the cap top 24 seats against the container neck lip 40. If there is no pressure relief passage provided through the seating area and out through the container and cap threads, pressure can build up in the annular pocket 42 which is defined by the inner container neck wall 32, the annular flange 30 and the inside wall or surface 38 of the cap top 24. This pocket pressure will act against the sealing force created by the container pressure, reducing the effectiveness of the seal created between the flange 30 and the inner container neck wall 32. To avoid this pocket pressure buildup, a passage is created through this seating area. This can be accomplished by a series of circumferentially spaced radially passages 44 in the inside wall 38 of the cap top 24 or in the container neck lip 40 created by a series of grooves or ribs. In the illustrated embodiment of FIGS. 1–4 and 6, these passages are shown as a circumferential series of radial passages 44 molded in the inside wall or surface 38 of the cap top 24. Arrows 46 in FIG. 3 show the flow of gas downstream from the pocket 42 through a passage 40 for relief to atmosphere through container and cap threads 16 and 28. These radial passages could alternatively be molded on the container neck lip 40, or the cap or lip could be knurled to create the passages.

Figure 5:
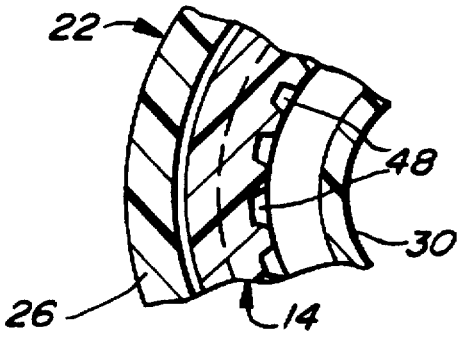
FIG. 5 is a partial cross-sectional view taken along line 5—5 of FIG. 4.

In the embodiment of FIGS. 4 and 5, provisions have been made to relieve container pressure to the atmosphere as the cap is being removed. A series of circumferentially spaced, axially extending passages 48 are provided in the neck inner wall 32 extending from a short distance above the sealing location 34 to the container lip 40. When the cap has been unthreaded from its fully tightened position shown in solid lines in FIG. 4 to a partially opened position shown at 22' in phantom, the sealing flange 30 will be moved upwardly to its position shown in phantom at 30', allowing the container pressure to bleed to atmosphere.

Figure 6:
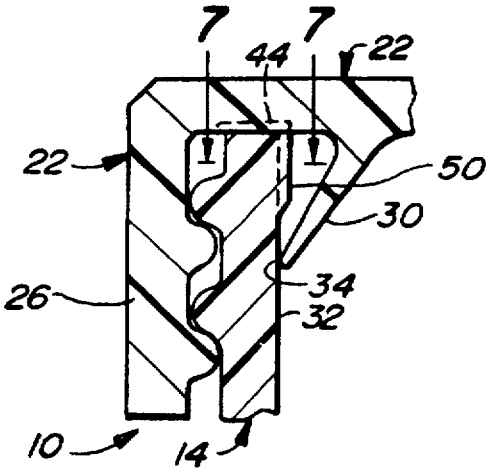
FIG. 6 is a sectional elevational view similar to FIGS. 3 and 4 showing another embodiment of the invention.
Figure 7:
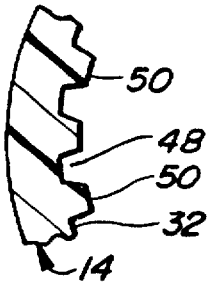
FIG. 7 is a partial cross-sectional view taken along line 7—7 of FIG. 6.

In the embodiments of FIGS. 6 and 7, provisions have also been made to relieve container pressure to the atmosphere as the cap is being removed. Here, a series of circumferentially spaced axially extending passages 48 are created by a series of circumferentially spaced, inwardly extending ribs 50 on the inner wall 32 extending axially from a short distance above the sealing location 34 to the container lip 40. As the cap is unthreaded, the flange 30 will contact the ribs 50 opening the container to the passages 48 between adjacent ribs 50.

Figure 8:
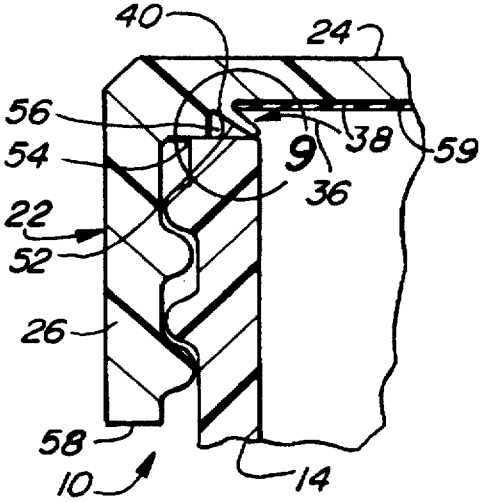
FIG. 8 is a sectional elevational view similar to FIGS. 3 and 4 showing another embodiment of the invention.
Figure 9:
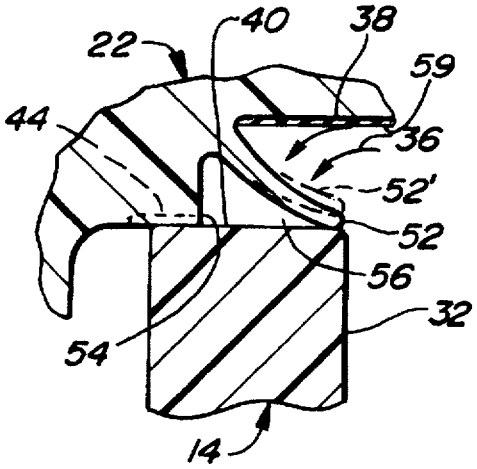
FIG. 9 is an enlarged cross-sectional view taken in the encircled area 9 of FIG. 8.

In the embodiment of FIGS. 8 and 9, a downwardly and inwardly or converging annular flange 52 extends from the cap top inside wall 38 into sealing contact with the container neck lip 40. The flange 52 is in the form of a flexible bead so that it can readily conform to any irregularities on the neck lip of the container which is usually blow molded. The container pressure pushes against the bead 52 in the direction of the arrows 36 in FIGS. 8 and 9 exerting a sealing force which tends to move the bead outwardly from a position shown exaggerated in phantom at 52' in FIG. 9 to its full line position. Thus an increase in container pressure results in an increase in sealing force on the bead 52 against the lip 40 in the same manner as the increase in sealing force of the flange 30 against the inner neck wall 32 in the embodiment shown in FIGS. 1, 3, 4 and 6.

In order to prevent crushing of the bead 52 and to provide a positive closed cap position stop, an annular shoulder 54 is provided extending inwardly and downwardly from the intersection of the annular cap skirt 26 and the inner cap top surface 38. Radial pressure relief passages 44 are also provided in the bottom of shoulder 54 to bleed any pressure build up in the pocket 56 to atmosphere in the same manner as radial passages 44 shown in FIGS. 1–4 and 6. Pocket 56 is created by the bead 52, shoulder 54 and container lip 40.

It will be apparent that the stop created by the shoulder 54 can alternatively be provided by bottoming the bottom 58 of the cap skirt 56 in FIG. 8 against a container shoulder, not shown, and that radial pressure relief passages 44 can be provided in the bottom 58 of the cap skirt or in the container shoulder. Likewise the cap 22 of FIGS. 1–6 can be tightened to a closed position by bottoming the bottom of the cap skirt 26 against the shoulder stop with suitable pressure relief passages 44 and with a clearance occurring between the container lip 40 and the inside wall 38 of the cap top 24 in the fully tightened position.

Figure 11:
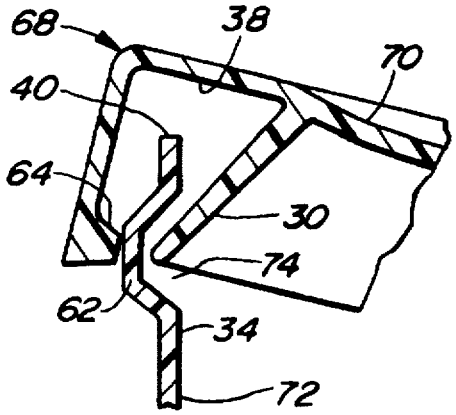
FIG. 11 is an enlarged view of a portion of FIG. 10 showing the closure cap partially removed from the container.
Figure 10:
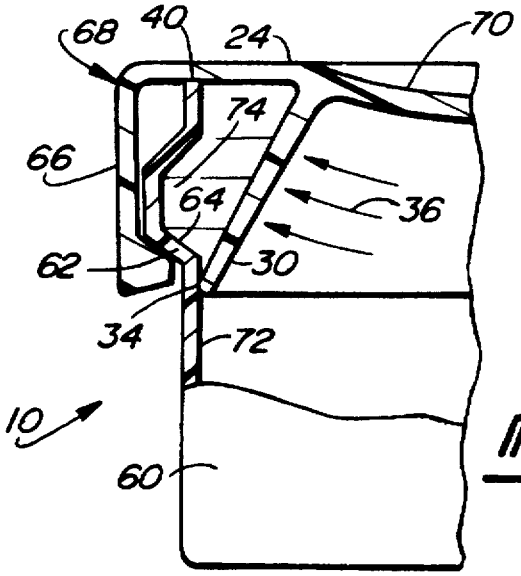
FIG. 10 is an elevational view partially in section of another embodiment of the invention.

In the embodiment of FIGS. 10 and 11, the container and closure package 10 employs a wide mouth container 60 having an outwardly projecting snap bead 62 which is engaged by an inwardly projecting snap bead 64 at the bottom of the annular skirt 66 of cap 68 as the container lip 40 bottoms against the inside wall 38 of the cap top 24. The central portion 70 of the cap top 24 can have an inward concave curve for strength from which the annular flange 30 diverges outwardly to seal against the inner container wall 72 at sealing location 34. A circumferential pressure relief passage 74 is formed on the inside of the container wall by the wall structure forming the snap bead 62. This allows the container pressure to be vented to atmosphere as the cap, closure or cover 68 is being snapped and tilted during removal as shown in FIG. 11.

It is apparent that many modifications and additions can be made to the various illustrated embodiments. The inside surface 38 of the cap top and the inner surface of the annular flange 30 or 52 can have a gas barrier coating such as the barrier coating 59 shown in FIGS. 8 and 9 to reduce diffusion of the pressurizing gas.

I claim:

1. A closure and container package in which the sealing force is increased with an increase in container pressure, said package comprising:

a container having a threaded neck;

a closure comprising:

a top wall;

an annular skirt wall depending from said top wall and having an internal thread for securing said cap to the threaded container neck;

an annular flange extending downwardly and diverging outwardly from said top wall contacting an inside wall of said container neck at a sealing location so that an increase in container pressure will increase the sealing force; and pressure equalizing means downstream from said sealing location including a passage located in the wall of one of said container and closure cap equalizing pressure downstream from said flange while said closure remains threaded on said container neck and said flange is contacting said inside wall of said container.

2. The closure and container package according to claim 1 wherein said passage includes a radial slot in one of an inside wall surface of said cap top and a lip wall of said container neck maintaining atmospheric pressure downstream from said sealing location.

3. The closure and container package according to claim 1 wherein said passage includes a slot in said inside wall of said container neck so that as said closure cap is being removed from the container, pressure in the container is relieved to the atmosphere before the closure cap is removed from the container.

4. The closure and container package according to claim 3 wherein said pressure equalizing means further includes a radial slot in an inside wall surface of said cap top wall maintaining atmospheric pressure downstream from said sealing location.

5. The closure and container package according to claim 2 wherein said radial slot is in said inside wall surface of said cap top.

6. The closure and container package according to claim 3 wherein said slot is axially oriented on the inside wall of said container neck.

* * * * *